US006464312B1

(12) United States Patent
Tenhundfeld et al.

(10) Patent No.: US 6,464,312 B1
(45) Date of Patent: Oct. 15, 2002

(54) REFRIGERATOR DOOR BREAKER ASSEMBLY

(75) Inventors: John Tenhundfeld, Cedar Rapids, IA (US); Jeff O'Halloran, Cedar Rapids, IA (US); Scot Davis, Williamsburg, IA (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 09/846,948

(22) Filed: May 1, 2001

(51) Int. Cl.[7] ..... A47B 96/04
(52) U.S. Cl. ..... 312/405; 312/296; 49/478.1
(58) Field of Search ..... 312/296, 405, 312/401, 400, 236; 49/478.1; 11/479.1; 24/303

(56) References Cited

U.S. PATENT DOCUMENTS

| | | | | |
|---|---|---|---|---|
| 2,446,336 A | * | 8/1948 | Mark et al. | 49/478.1 X |
| RE23,636 E | | 3/1953 | Mark et al. | |
| 2,659,114 A | * | 11/1953 | Anderson et al. | 49/478.1 X |
| 2,914,819 A | | 12/1959 | Janos | |
| 3,009,725 A | * | 11/1961 | Koch | 49/478.1 X |
| 3,077,644 A | | 2/1963 | Kesling | |
| 3,461,610 A | | 8/1969 | Peters et al. | |
| 3,468,449 A | | 9/1969 | Harty, Jr. | |
| 3,487,581 A | * | 1/1970 | Ellingson, Jr. | 49/478.1 |
| 4,653,819 A | | 3/1987 | Swerbinsky | |
| 4,732,432 A | | 3/1988 | Keil et al. | |
| 5,269,099 A | | 12/1993 | Kennedy et al. | |
| 5,309,680 A | * | 5/1994 | Kiel | 49/478.1 |
| 5,476,318 A | | 12/1995 | Yingst et al. | |
| 5,560,694 A | * | 10/1996 | Banicevic et al. | 312/405 |
| 5,706,607 A | * | 1/1998 | Frey | 49/478.1 |
| 5,816,080 A | * | 10/1998 | Jeziorowski et al. | 312/405 X |
| 5,975,661 A | | 11/1999 | Jeziorowski et al. | |
| 5,975,664 A | * | 11/1999 | Banicevic et al. | 312/405 |
| 6,056,383 A | | 5/2000 | Banicevic et al. | |

FOREIGN PATENT DOCUMENTS

| | | | | |
|---|---|---|---|---|
| DE | 3708176 | * | 11/1988 | 49/478.1 |
| GB | 2257192 | * | 1/1993 | 49/478.1 |

* cited by examiner

*Primary Examiner*—Lanna Mai
*Assistant Examiner*—Hanh V. Tran
(74) *Attorney, Agent, or Firm*—McKee, Voorhees & Sease, P.L.C.

(57) ABSTRACT

Thermal breakers and door seal arrangements for refrigerators and the like are described that provide a floating magnet within the breaker. The floating magnet is capable of lateral movement within a compartment in the breaker. In the case of a misaligned refrigerator or freezer door, the floating magnet will adjust its position within the breaker compartment to become properly aligned with the magnetic elements in the door gasket. Magnetic attraction will assist this adjustment in the breaker magnet. The floating magnet is asymmetrical so that it cannot be inadvertently installed in a reversed position. The breaker assembly provides a plastic extrusion that retains the floating magnet and a post condenser loop element in contact with the outward-facing wall of the breaker. The post condenser loop circulates heated condenser fluid from the refrigeration mechanism along the outward-facing wall of the breaker, thereby helping to evaporate excess condensation and reducing or eliminating "sweating" on the breaker. The extrusion is a single molded piece that engages the breaker assembly in a snap-fit manner.

20 Claims, 3 Drawing Sheets

REFRIGERATOR DOOR BREAKER ASSEMBLY

BACKGROUND OF THE INVENTION

1. Field of the Invention

The present invention relates generally to the design of refrigerators and refrigeration equipment. In particular aspects, the invention relates to magnetic seals for refrigerator doors and thermal breakers used in refrigerator cabinets.

2. Description of the Related Art

It is of primary importance in refrigeration design to provide positive and secure sealing for the closures of a refrigerator and freezer. If the seal around the closure is not secure and substantially free from fluid leakage, significant amounts of cold air will escape, and it will be difficult to maintain the contents of the refrigerator or freezer at a desired temperature. The seal around the closure is the area where the most cool air escapes the refrigerator and results in the greatest energy loss.

Most conventional magnetic refrigerator door sealing assemblies use magnetic elements within or behind the door gasket to cause the gasket to seal against a portion of the refrigerator cabinet. In a common type of sealing assembly, the magnetic elements within the gasket are attracted to a portion of the outer metal shell of the refrigerator cabinet. Examples of this type of sealing arrangement are described in U.S. Pat. Nos. 2,914,819; 3,077,644; 3,461,610; 3,468,449; and 4,653,819.

In other door sealing arrangements, the door gasket seals against a thermal breaker on the refrigerator cabinet. Thermal breakers are desirable to insulate the refrigerated air inside of the refrigerator cabinet against the outside air. The materials used to form the thermal breakers are plastic or another non-magnetic material that is less conductive of heat than metal. The magnetic elements associated with the door gasket are attracted to complimentary magnetic elements concealed within the thermal breaker assembly. Examples of thermal breaker arrangements are found in U.S. Pat. Nos. 4,732,432; 5,269,099; 5,476,318 and 6,056,383. While thermal breakers are highly desirable, there is a problem associated with their long term use. When the refrigerator ages and/or is subjected to wear and weight placed upon the door, the door may begin to sag from the hinges or hang askew. When this occurs, the magnets can become easily misaligned and do not close onto the proper portion of the breaker. In the worst cases, when the door is closed, the north or south pole of some or all of the magnetic elements in the door gasket become lined up with the portion of the magnetic element in the breaker that is of the same polarity. When this occurs, the magnetic elements repel one another, thereby causing an improper seal. Sealing of the door is prevented by magnetic repulsion of the gasket from the breaker so that gaps occur, thus allowing cool air from the compartment of the refrigerator to escape.

Another problem with conventional door breakers stems from the fact that the magnets within the breaker are typically rectangular in cross section. They are sometimes made of metal, but more conventionally are formed of vinyl having one side impregnated with metallic flakes that are then magnetically charged to provide a north and south pole. There is a risk that these magnets might be inadvertently flipped upside down either when the magnet is installed initially or when repairs are made.

A related problem with conventional thermal breaker design is that thermal breakers tend to "sweat" as condensation gathers on them. A further problem with convention thermal breaker design relates to the number of components that are required to be assembled to compose the breaker. A minimum number of parts would be desirable to minimize costs.

It would be desirable to have devices and methods that address the problems of the prior art.

SUMMARY OF THE INVENTION

Exemplary refrigerator thermal breakers and door seals are described that provide for a floating magnet within the breaker. The floating magnet is capable of lateral movement within a compartment in the breaker. In the case of a misaligned refrigerator or freezer door, the floating magnet will adjust its position within the breaker compartment to become properly aligned with the magnetic elements in the door gasket. Magnetic attraction will assist this adjustment in the breaker magnet. In the exemplary embodiments described herein the floating magnet is asymmetrical so that it cannot be inadvertently installed in a reversed position.

In addition, the exemplary breaker provides a plastic extrusion that retains not only the floating magnet but a post condenser loop element in contact with the outward-facing wall of the breaker. The post condenser loop circulates heated condenser fluid from the refrigeration mechanism along the outward-facing wall of the breaker, thereby helping to keep the breaker above the ambient air dew point and reducing or eliminating "sweating" on the breaker. The extrusion is a single molded piece that engages the breaker assembly in a snap-fit manner.

DETAILED DESCRIPTION OF PREFERRED EMBODIMENTS

Figure 1:
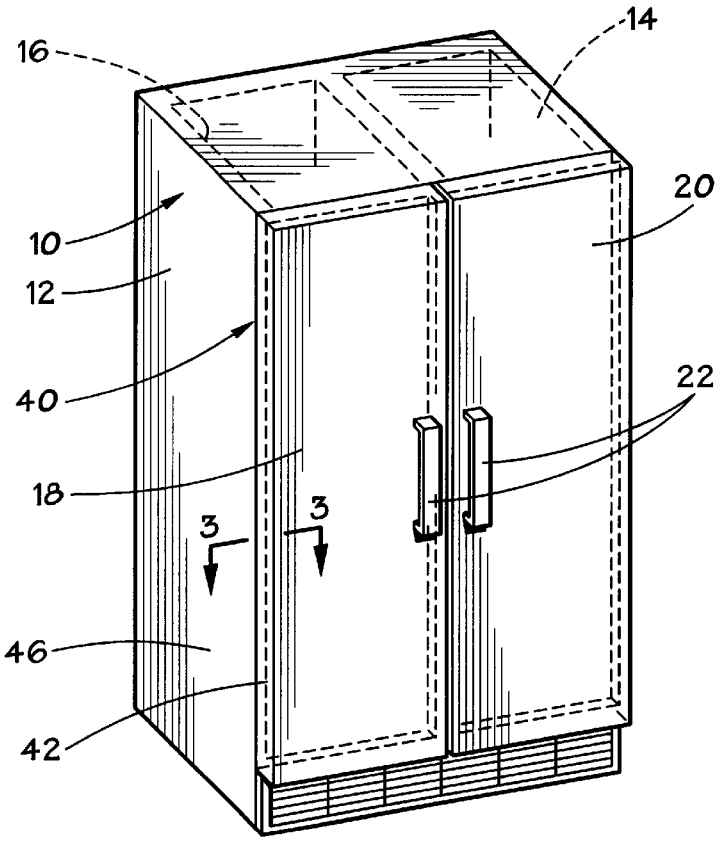
FIG. 1 is an isometric view of an exemplary side-by-side model refrigerator incorporating a breaker assembly constructed in accordance with the present invention.

Referring first to FIG. 1, there is shown an exemplary refrigerator 10 that incorporates an exemplary sealing arrangement and breaker in accordance with the present invention. The refrigerator 10 includes an insulated body 12 that is divided to enclose a refrigerator compartment 14 and a freezer compartment 16, which are located next to one another in a side-by-side configuration. Although the refrigerator 10 is shown as having a side-by-side relation for the refrigerator and freezer compartments 14, 16, it should be noted that the invention applies as well to refrigerator styles in which the freezer and refrigerator compartments are disposed one atop the other. In addition, it should be understood that the present invention has application to commercial refrigeration equipment and other devices wherein a gasket seal for the opening is maintained using magnetic elements.

Figure 2:
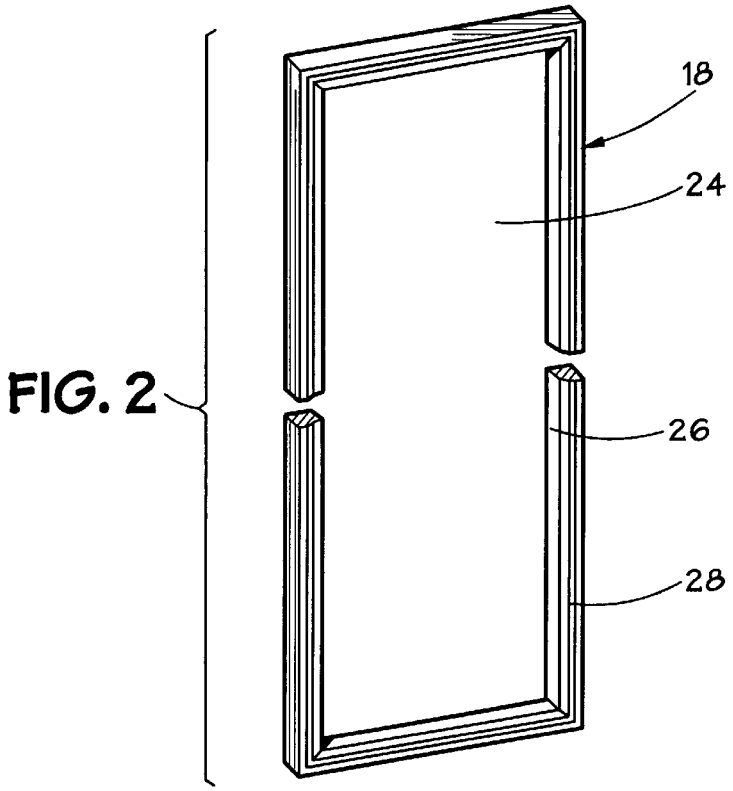
FIG. 2 depicts the interior side of one of the doors used with the refrigerator shown in FIG. 1.

Exemplary doors 18, 20 are secured by hinged attachment to the insulated body 12 so that the doors will open away from the body 12 while pivoting upon the hinged attachments. It is noted that, although hinged doors 18, 20 are used to illustrate the invention, the invention is equally applicable to non-hinged door closures, such as those associated with pull-out drawer type refrigerator openings. The doors 18, 20 have handles 22 that can be grasped to easily open the doors. FIG. 2 shows door 18 apart from the body 12 and other portions of the refrigerator 10, and specifically shows the interior side surface 24, typically fashioned of plastic, that faces into the freezer compartment 16 when the door 18 is closed. The door 18 has a raised dike 26 peripherally surrounding of the interior side surface 24. A sealing gasket assembly 28 is mounted upon the dike 26 and also surrounds the entire periphery of the interior surface 24. The structure of the sealing gasket assembly 28 is best appreciated with reference to FIGS. 3 and 4 and includes a gasket member 30 formed of rubber or another suitable elastomeric material that defines a number of collapsible air spaces 32, 34. A first magnetic element 36 is encased within the gasket member 30. The first magnetic element 36 is an elongated rectangle and is preferably a dual pole magnet having either north or south poles at each of its latitudinal ends with the central portion of the element having the opposite polarity.

Figure 3:
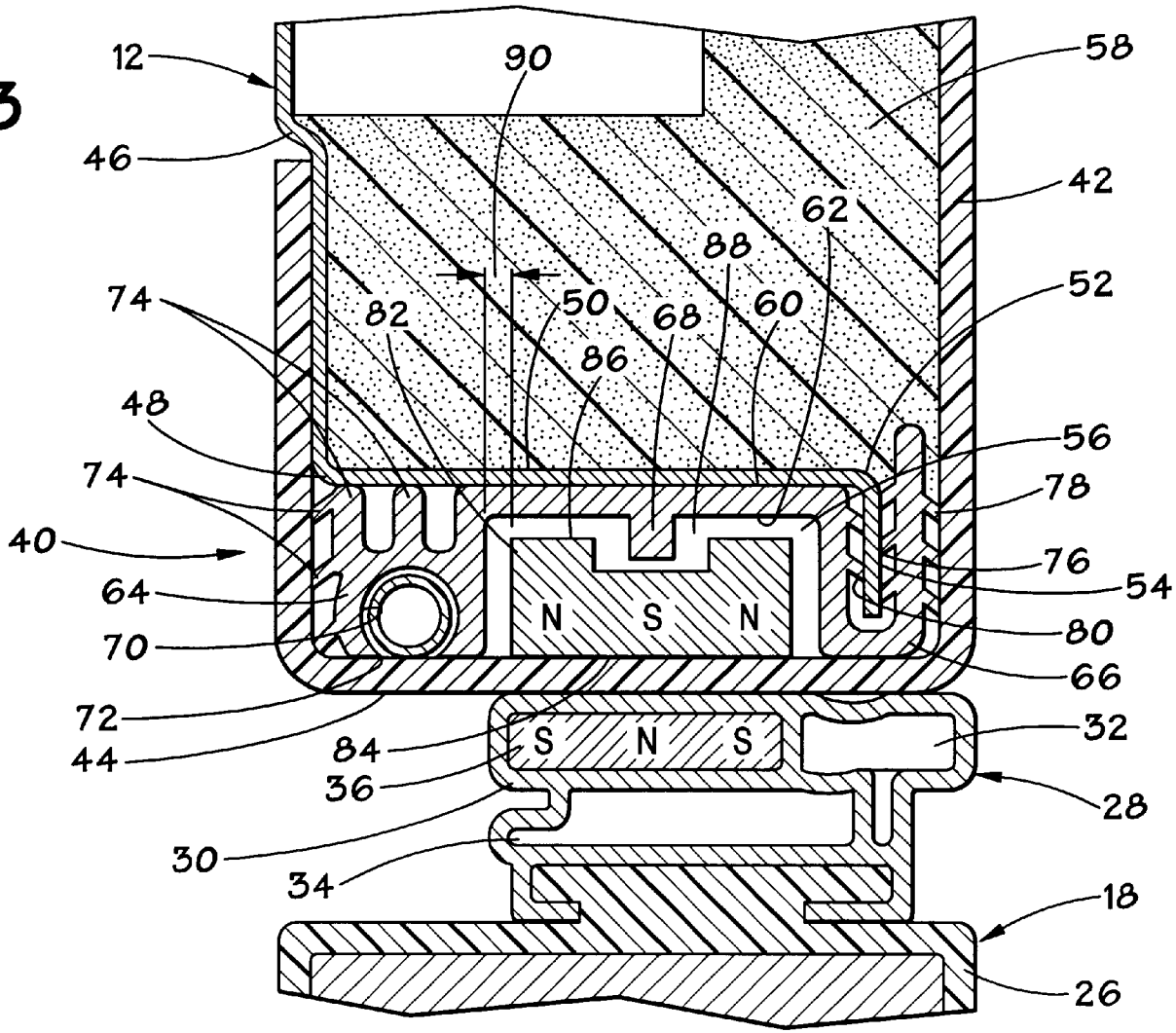
FIG. 3. is a plan cross-sectional view of an exemplary breaker assembly constructed in accordance with the present invention.
Figure 4:
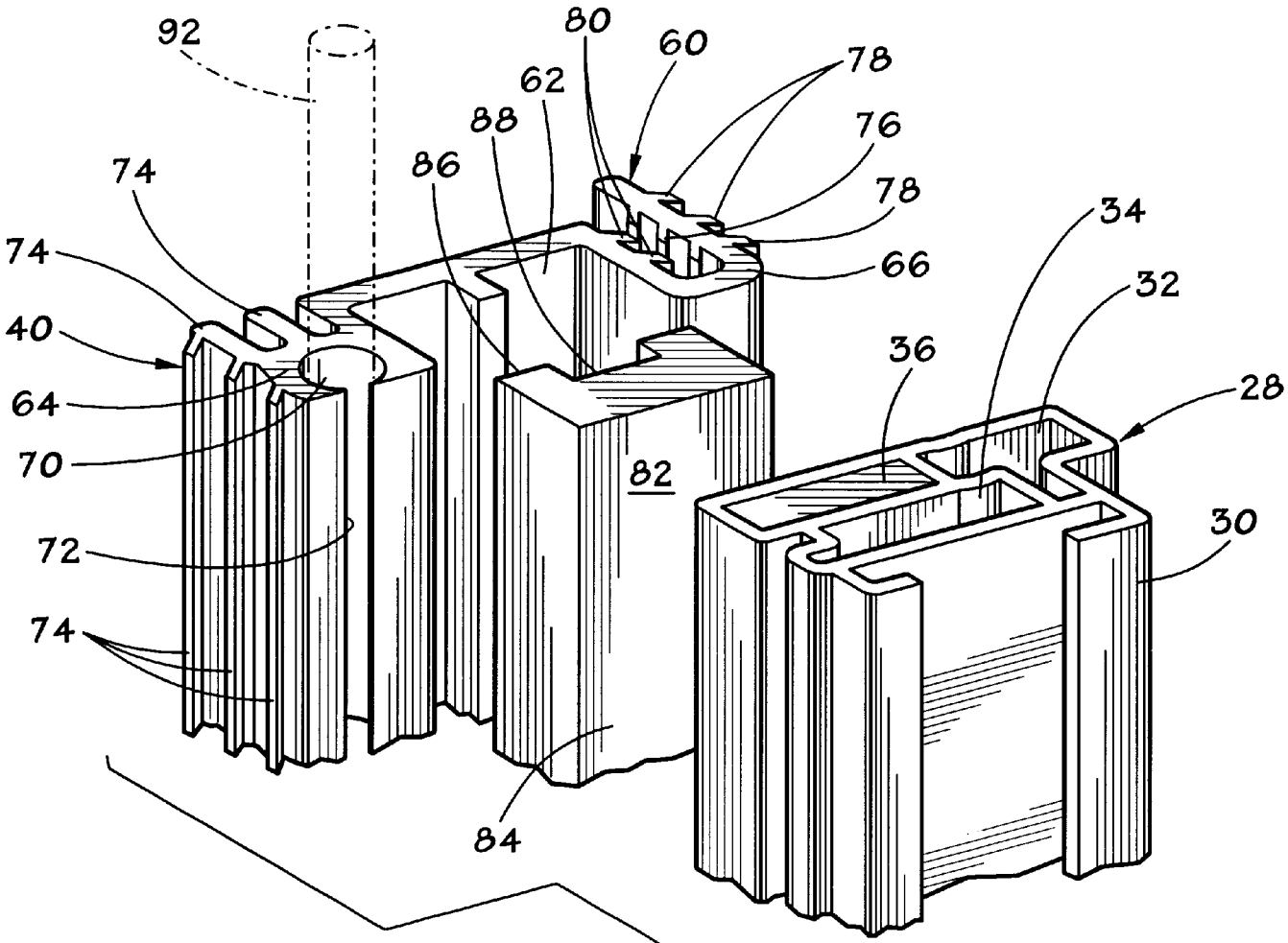
FIG. 4. is a partially exploded, isometric view of some components of the breaker assembly shown in FIG. 3.

The forward portion of each of the refrigerator and freezer compartments 14, 16 within the refrigerator body 12 defines a thermal breaker assembly 40 which is shown in detail in FIGS. 3 and 4. The thermal breaker 40 typically extends all the way around the openings of both the refrigerator and freezer compartments 14, 16. The thermal breaker assembly 40 is primarily formed of insulative materials to prevent or slow the transmission of heat. Thus, the breaker assembly 40 is generally encased within the outer plastic housing 42 (see FIG. 3) that lines the interior of the compartments 14, 16. While the exemplary housing 42 is described as being "plastic," it may be formed of another non-magnetic material having suitable resistance to heat conductivity. The plastic housing 42 presents a substantially flat outer contact surface 44 that the gasket member 30 contacts and seals against when the door is closed against the body 12. The breaker assembly 40 is enclosed by the outer metal shell 46 and the plastic housing 42 of the refrigerator body 12. The contact surface 44 is smooth with no seams upon it, thereby facilitating cleaning of the contact surface 44. As FIG. 3 illustrates, the metal shell 46 is bent approximately 90° at 48 to provide a backing plate 50 that runs parallel to and behind the contact surface 44. A reverse bend 52 is given to the backing plate 50 to provide a side flange 54. When the metal shell 46 and the plastic housing 42 are assembled, a chamber 56 is defined between the backing plate 50 and the contact surface 44. Foam insulation 58 is disposed within the breaker assembly 40 behind the back plate 48.

A formed plastic extrusion 60 is retained within the chamber 56. The extrusion 60 is shaped to engage portions of the chamber 56 and retain other elements within the breaker assembly 40 in a convenient manner. The extrusion 60 is a single molded piece that can be easily inserted into breaker assembly 40 during assembly. The extrusion 60 includes a central channel 62 that is defined laterally between left and right side pieces 64, 66. A raised ridge 68 is disposed along the center of the channel 62. The left side piece 64 defines a rounded groove 70 with an open front side 72. A plurality of wall-contacting fins 74 project outwardly from the left side piece 64.

The right side piece 66 is U-shaped and encloses a slot 76. Wall-contacting fins 78 project outwardly from the right side piece 66 to prevent foam 58 from entering the channel 62 while engagement fins 80 project into the slot 76. When the breaker assembly 40 is assembled, as shown in FIG. 3, the engagement fins 80 engage the side flange 54. It is noted that the extrusion 60 is a single piece that is easily inserted into the breaker assembly 40 in a snap-fit manner.

A second magnetic element 82 is loosely retained within the channel 62 of the extrusion 60 against the contact surface 44 of the plastic housing 42. The second magnetic element 82 is of an asymmetrical design in that the front side or face 84 of the element 82 has a different shape from the rear side or face 86. In the embodiment shown in FIGS. 3 and 4, the second magnetic element 82 has a front face 84 that is flat while the rear face 86 contains a longitudinal channel 88 therein. When the breaker assembly 40 is assembled, the second magnetic element 82 is a "floating magnet" that is able to move, at least laterally, within the channel 62. As indicated at 90 in FIG. 3, spacing is provided between the second magnetic element 82 and the two side pieces 64, 66 of the extrusion 60, allowing the magnetic element 82 to move freely therein. Additionally, the raised ridge 68 of the extrusion 60 resides within the channel 88 of the second magnetic element 82 without being urged into contact therewith, thereby preventing frictional resistance to lateral movement of the magnetic element 82 within the channel 62.

Like the first magnetic element 36, the second magnetic element 82 is a dual pole magnetic element. It does, of course, have an opposite polarity than the first magnetic element 36 so that the elements are attracted to one another. The use of dual pole magnets greatly improves the sealing of the refrigerator seal since the magnetic attraction is increased as compared to single pole magnets.

As illustrated in FIGS. 3 and 4, a post condenser (PC) loop element 92 is retained within the rounded groove 70 of extrusion 60. The PC loop 92 is a metallic, usually copper, tube that carries warm condenser fluid between components of the cooling system of the refrigerator 10. When the extrusion 60 is snap-fit into the breaker assembly 40, it retains the PC loop 92 in contact with the contact surface 44 of the breaker assembly 40. Due to the open front side 72 of the groove 70, the PC loop 92 directly contacts the surface 44. This direct contact warms the contact surface 44 to reduce or eliminate sweating of the surface 44.

The breaker assembly 40 of the present invention also prevents sealing problems that tended to develop in the prior art from misalignment of the refrigerator doors. In particular, the floating magnet feature of the breaker assembly 40 compensates for door misalignment and permits the second magnetic element 82 to align itself with the first magnetic element 36 in such a case. The magnetic attraction of the first magnetic element 36 is the external force that urges the second magnetic element 82 into proper alignment with the first element 36. The presence of spacing 90 allows the second magnetic element 82 to float to a proper position within the breaker assembly 40.

While the invention has been shown in only some of its forms, it should be apparent to those skilled in the art that it is not so limited, but is susceptible to various changes without departing from the scope of the invention.

What is claimed is:

1. A refrigerator comprising:

a refrigerator cabinet body that encloses a compartment;

a door operatively associated with the body to selectively enclose the compartment;

a first magnetic element fixedly secured to a portion of the door;

a thermal breaker assembly incorporated into the cabinet body, the thermal breaker assembly comprising:

a non-metallic contact sealing surface to receive a sealing element associated with the door;

a chamber defined behind the contact sealing surface for retaining a magnetic element therein; and an asymmetrical second magnetic element disposed within the chamber, the second magnetic element being laterally moveable within the chamber to become aligned with the first magnetic element.

2. The refrigerator of claim 1 wherein the first and second magnetic elements are dual pole magnets.

3. The refrigerator of claim 1 wherein the second magnetic element presents a rear side face that defines a channel therein.

4. The refrigerator of claim 1 further comprising a plastic extrusion to define the chamber.

5. The refrigerator of claim 3 wherein the chamber defines a raised ridge that resides within the channel of the second magnetic element when the second magnetic element is correctly disposed within the chamber.

6. A thermal breaker assembly for a refrigerator comprising:

a chamber substantially defined within a non-metallic material that is substantially resistant to heat transfer and that includes a sealing surface lying in a plane; and a magnetic element disposed within the chamber, the magnetic element being sized and shaped to be laterally moveable within the chamber in a direction parallel to the plane of the sealing surface.

7. The breaker assembly of claim 6 wherein the magnetic element has a longitudinal axis and is asymmetrical about its longitudinal axis.

8. The breaker assembly of claim 6 further comprising a fluid carrying element within the chamber that is retained against the non-magnetic material for transfer of heat from the fluid carrying element to the non-magnetic material.

9. The breaker assembly of claim 6 wherein the magnetic element is a dual pole magnetic element.

10. The breaker assembly of claim 7 wherein the magnetic element is asymmetrical by providing a substantially flat front side and a rear side having a groove therein.

11. A thermal breaker assembly for a refrigerator comprising:

an outer housing having a single layer of material forming a contact sealing surface against which a door gasket may seal; and a post condenser loop for carrying warm fluid disposed within the housing and retained in contact with the single layer of material forming the contact sealing surface;

a magnetic element retained within the outer housing so as to be moveable therein in response to an external magnetic pull; and a molded extrusion that is insertable into the outer housing to retain the post condenser loop in intimate surface contact with the single layer of material forming the contact sealing surface.

12. The thermal breaker assembly of claim 11 wherein the molded extrusion defines a channel for retaining the magnetic element within the outer housing.

13. The thermal breaker assembly of claim 11 wherein the magnetic element is moveable laterally within the channel behind the contact sealing surface.

14. The thermal breaker assembly of claim 11 wherein the magnetic element is asymmetrical about a longitudinal axis to preclude reverse installation of the magnetic element within the breaker assembly.

15. The thermal breaker assembly of claim 14 wherein the magnetic element is made asymmetrical by disposing a groove in one side of said magnetic element.

16. The thermal breaker assembly of claim 13 wherein the magnetic element comprises a dual pole magnetic element.

17. A refrigerator comprising:

a refrigerator cabinet body that encloses a compartment;

a door operatively associated with the body to selectively enclose the compartment;

a sealing element associated with the door;

a first magnetic element fixedly secured to a portion of the door;

a thermal breaker assembly incorporated into the cabinet body and comprising a single layer of non-metallic material forming a contact sealing surface to contact the sealing element associated with the door, a chamber defined behind the contact sealing surface, a second magnetic element disposed within the chamber and being laterally moveable within the chamber to become aligned with the first magnetic element;

a fluid carrying element adapted to carry a warm condenser fluid, the fluid carrying element being retained in contact with the single layer of non-metallic material forming the contact sealing surface.

18. The refrigerator of claim 17, wherein the fluid carrying element is retained in contact with the sealing surface by a snap-in plastic extrusion.

19. A refrigerator comprising:

a refrigerator cabinet body that encloses a compartment;

a door operatively associated with the body to selectively enclose the compartment;

a sealing element associated with the door;

a first magnetic element secured to the sealing element;

a thermal breaker assembly incorporated into the cabinet body and comprising a contact sealing surface lying in a plane for contacting and forming a seal with the sealing element of the door, a chamber formed behind the contact sealing surface, and a second magnetic element disposed within the chamber;

the chamber being larger than the second magnetic element and permitting said second magnetic element to move in a direction parallel to the plane of the contact sealing surface.

20. A refrigerator according to claim 19 wherein the chamber is sufficiently larger than the second magnetic element to permit the second magnetic element to move in a direction perpendicular to the plane of the contact sealing surface.

* * * * *